United States Patent [19]

Egri

[11] Patent Number: 4,483,352

[45] Date of Patent: Nov. 20, 1984

[54] METHOD OF INCREASING THE VOLUME OF CUT TOBACCO RIBS AND AN APPARATUS FOR CARRYING OUT SAID METHOD

[75] Inventor: Laszlo Egri, Basel, Switzerland

[73] Assignee: Tamag Basel AG, Birsfelden, Switzerland

[21] Appl. No.: 307,800

[22] Filed: Oct. 2, 1981

[30] Foreign Application Priority Data

Oct. 7, 1980 [DE] Fed. Rep. of Germany ..... 3037885

[51] Int. Cl.[3] ..... A24B 3/18

[52] U.S. Cl. ..... 131/296; 131/302; 131/303; 131/304

[58] Field of Search ..... 131/302, 293, 296, 241, 131/303, 304

[56] References Cited

U.S. PATENT DOCUMENTS 4,040,431 8/1977 Ashworth et al. ..... 131/296
4,211,243 7/1980 Ohno et al. ..... 131/291
4,274,427 6/1981 Lenduay ..... 131/293
4,301,819 11/1981 Davies et al. ..... 131/302

FOREIGN PATENT DOCUMENTS 2637124 3/1977 Fed. Rep. of Germany ..... 131/296

*Primary Examiner*—Vincent Millin
*Attorney, Agent, or Firm*—Hubbell, Cohen, Stiefel & Gross

[57] ABSTRACT

The invention relates to an apparatus and a method of increasing the volume of cut tobacco ribs by impregnating tobacco ribs with an impregnating agent, which contains at least water, up to a water content of at least 45% by weight, heating the impregnated tobacco rib parts with a gaseous heating and transport medium containing steam and having a temperature of from approx. 105° to approx. 250° C., said tobacco rib parts being transported through an expansion zone and a drying zone a pneumatic transport system. The impregnated tobacco rib parts are kept in the expansion and drying zones for a period of at least approx. 10 seconds and are dried to a final moisture content of at least 12.5% by weight.

22 Claims, 4 Drawing Figures

METHOD OF INCREASING THE VOLUME OF CUT TOBACCO RIBS AND AN APPARATUS FOR CARRYING OUT SAID METHOD

CROSS-REFERENCE TO RELATED APPLICATIONS

This application is based on German application No. P3037885.9, filed Oct. 7, 1980, convention priority of which is claimed under 35 USC 119.

BACKGROUND OF THE INVENTION

1. Field of the Invention

The invention refers to a method of increasing the volume of cut tobacco stems by impregnating the cut ribs at least with water, heating and drying the impregnated cut ribs in a pneumatic transport system by means of a gaseous heating and transport medium containing steam as well as to an apparatus for carrying out said method.

2. Description of the Prior Art

A plurality of methods are known in the case of which, for the purpose of drying tobacco and/or increasing the volume thereof, said tobacco is treated by being brought into contact with hot gases, such as air, air/steam or steam alone. In GB Pat. No. 875,684, for example, a method is described in the case of which the tobacco is dried by means of heated air. U.S. Pat. No. 3,357,436 describes an apparatus for drying tobacco in the case of which humid, heated air having a water content of at least 10% is used, the tobacco being treated in a pneumatic system at a temperature of from approx. 65° C. to approx. 316° C. The patent description discloses that the drying is carried out comparatively slowly using several drying towers and that the initial moisture content of the tobacco to be treated must not exceed 35% by weight. Accordingly, very low filling power increases of e.g. 2.3% are reported.

In the case of another type of method the tobacco is intensively moistened and is also exposed to a heating medium, which solely consists of hot air, in a heating zone. Such a method is described in German-Auslegeschrift No. 21 03 669. According to said method the intensively moistened and, consequently, swollen up tobacco is heated by means of a hot gas such that only the marginal area on the surface of a tobacco particle is dried to a considerable extent in comparison with the inner area thereof, whereby a solid consistency—as compared to the consistency of the inner area—and, consequently, stability of shape of the swollen up tobacco particle is to be achieved after a speedy cooling-down process. The drying process as such is carried out in a means in which the moistened tobacco is transported—and simultaneously vibrated—on a conveyor belt through individual drying chambers through which a stream of hot air passes.

In the case of this method the speed of the gaseous heating and drying medium is reduced to such an extent that the tobacco or tobacco rib particles can only be maintained in the suspension state. This has the effect that the drying time is several minutes; the large number of gas inlet points in the moving-bed base effects, on the one hand, a certain amount of swirl in the tobacco particle layer, but, on the other hand, this mode of operation results in channel formation and, consequently, in non-uniform expansion effects as well as in a varying final moisture content of the treated tobacco material.

U.S. Pat. No. 3,734,104 and German-Auslegeschrift No. 2 253 882, respectively, describe a method according to which moistened, cut tobacco ribs are dried at a temperature of from 121° C. to 371° C. for a period of from 0.3 to 3 seconds at the most by means of a gaseous heating medium containing vapour. In the case of this method the ribs are pneumatically transported at a very high speed and are dried from a moisture content of from 24 to 60% down to a moisture content of as little as 6%. After having been treated, the filling capacity of the ribs measured by means of a densimeter is increased up to 50%.

The same patent specification demonstrates by means of examples the influence of the final moisture content of treated cut ribs on the increase in volume. For example, the density of cut ribs dried to a moisture content of 13.8% exceeds the density of cut ribs dried to 6.0% by approx. 12% and the density of cut ribs dried to a moisture content of 14.5% exceeds the density of cut ribs dried to 6.0% by approx. 23%, i.e. according to the teaching of the above-mentioned patent specification the volume increasing effect increases as the final moisture content of the treated material decreases.

The essential disadvantages of such a method are:

The high rates of drying required for obtaining a favourable volume effect can—if the very short treatment times are observed—only be achieved by means of very high temperatures, this having the effect that the fire risk is increased and that a high amount of energy is consumed.

The cut ribs dried to a water content of less than 10% become very friable, whereby—in view of the high transport speeds—a high loss due to fragmentation and dust formation is caused.

The treated cut ribs must be remoistened to a moisture content of from 12 to 13% prior to further processing, whereby a considerable part of the obtained increase in volume can get lost, if no additional, in some cases rather complicated measures are taken.

As mentioned in German-Offenlegungsschrift No. 29 43 373, the tobacco material is even dried to a final moisture content of 3% in order to obtain a satisfactory increase in volume. The above-mentioned Offenlegungsschrift additionally describes a complicated and expensive method of remoistening the expanded tobacco, which is employed for the purpose of limiting the loss of effect, which would otherwise be caused, to a minimum.

SUMMARY OF THE INVENTION

It follows that a plurality of factors are important in connection with the absolute amount of the increase in volume of tobacco material. For effecting an expansion of the tobacco cells, it is first of all important that the heat is transferred rapidly enough for causing at least part of the contents of the cells to evaporate before the cell walls are rendered inelastic due to drying off. However, evaporation must not occur to such an extent that the tobacco cells are destroyed by the inner excess pressure. An additional factor which has turned out to be important is that in the subsequent drying process the moisture is removed from the tobacco under comparatively mild temperature and transport conditions so that the surface of the tobacco particle will not be rendered excessively brittle and, consequently, susceptible to abrasion.

The object of the present invention is to provide a method by means of which the volume of cut tobacco ribs can be efficiently increased in a simple and economical manner and which eliminates the disadvantages of the known methods.

Surprisingly enough, it has turned out that this task can be solved by a method of the type mentioned at the beginning, in the case of which the cut ribs, which have been moistened to a water content of at least 45%, are dried in a pneumatic transport system (pneumatic drier) at a temperature of from 105° C. to approx. 250° C. of the gaseous heating and transport medium, which contains steam, for a period of at least 10 seconds to a minimum final moisture content of 12.5% by weight. By determining the weight, firmness and pressure drop relation of the cigarettes made of a mixture comprising the cut ribs treated in accordance with the invention and laminae it has been found that almost the entire volume effect of the cut ribs dried preferably to a water content of from 13 to 14% by weight turned up again in the final product.

In the case of the method according to the invention it is expedient to feed the tobacco impregnated with an expansion medium into the stream of gaseous heating medium in the normal way directly prior to the heating zone.

Particularly advantageous results with regard to the expansion effect as well as with regard to the duct formation and the further processing of the treated cut ribs have been achieved when the cut ribs were dried within a period of from approx. 10 to approx. 20 seconds, preferably of from approx. 15 to approx. 20 seconds.

In view of the fact that tobacco ribs normally have a comparatively inelastic and wood-like structure, an initial moisture content of from 40 to 60% by weight of the cut ribs to be treated is particularly advantageous for the purpose of softening the tobacco ribs and, consequently, for the purpose of obtaining a substantial expansion in accordance with the method according to the invention. For maintaining the elasticity of the cell walls, in particular during the first phase of the tobacco rib treatment according to the invention, and for influencing thus the increase in volume of the tobacco cells in a favourable way, the gaseous heating and transport medium should contain at least 50 percent by volume of steam. Its temperature should preferably be 150° to 180° C. immediately prior to the cut tobacco rib inlet.

In connection with the above-mentioned rapid transfer of the heat from the heating medium to the tobacco parts, which is particularly important in the first phase of the treatment for obtaining good volume effects, the present invention caused—in a special mode according to the invention—the increase in turbulence which, as is generally known, is capable of removing (destroying) the laminar boundary layer on the surface of the tobacco particles, said boundary layer inhibiting the transfer of heat. According to the invention, the impregnated tobacco rib parts are deflected several times in their direction of movement while being transported and the speeds of said tobacco rib parts are changed several times relative to the gaseous heating and transport medium containing steam. This has the effect that high turbulences and heat transfer speeds are obtained, without the necessity of achieving this in the conventional way by means of high transport speeds and the resultant disadvantages, such as an increase in fragmentation and dust formation or short dwell times with corresondingly high temperatures.

According to the invention, the changes in the direction and relative speeds are effected by the pneumatic transport of the tobacco rib parts along the plurality of oppositely disposed and/or mutually offset deflection means. It has been found that due to the use of the deflection means according to the invention the temperature of the gaseous heating and transport medium containing steam can be substantially reduced—without any change in the initial and final moisture contents of the tobacco rib material—and the increase in volume achieved will at least remain equal.

For the organoleptic properties of the treated ribs, an impregnation of the ribs with an impregnating agent consisting of water with an addition of orthophosphoric acid and/or the sodium salts thereof has turned out to be advantageous.

A particularly advantageous effect with regard to the smoke taste of treated cut ribs will be achieved when orthophosphoric acid and/or the sodium salts thereof are added to the water in an amount of from 0.1 to 1.0% by weight based on the dry weight of the tobacco ribs.

In order to be capable of carrying out careful drying of the cut ribs and in order to obtain at the same time a uniform final moisture content, the present invention provides the feature of installing in the pneumatic system a preferably vertical shaft whose flow cross-section increases in size in the direction of transport of the tobacco material. By means of a suitable dimensioning of the enlarged cross-sectional area the flow rate is reduced to such an extent that only the parts having a particular specific gravity, i.e. a particular moisture, are advanced.

The drying of the cut ribs is carried out particularly carefully when the temperature of the gaseous heating and transport medium containing steam is preferably of from 110° C. to approx. 150° C. in the zone of the enlarged cross-sectional area.

After the expansion, the tobacco is separated from the gaseous transport medium e.g. in a cyclone separator and is subjected to further processing.

BRIEF DESCRIPTION OF THE DRAWINGS

In the following the invention will be explained in detail by reference to the drawings, in which.

DETAILED DESCRIPTION

Figure 1:
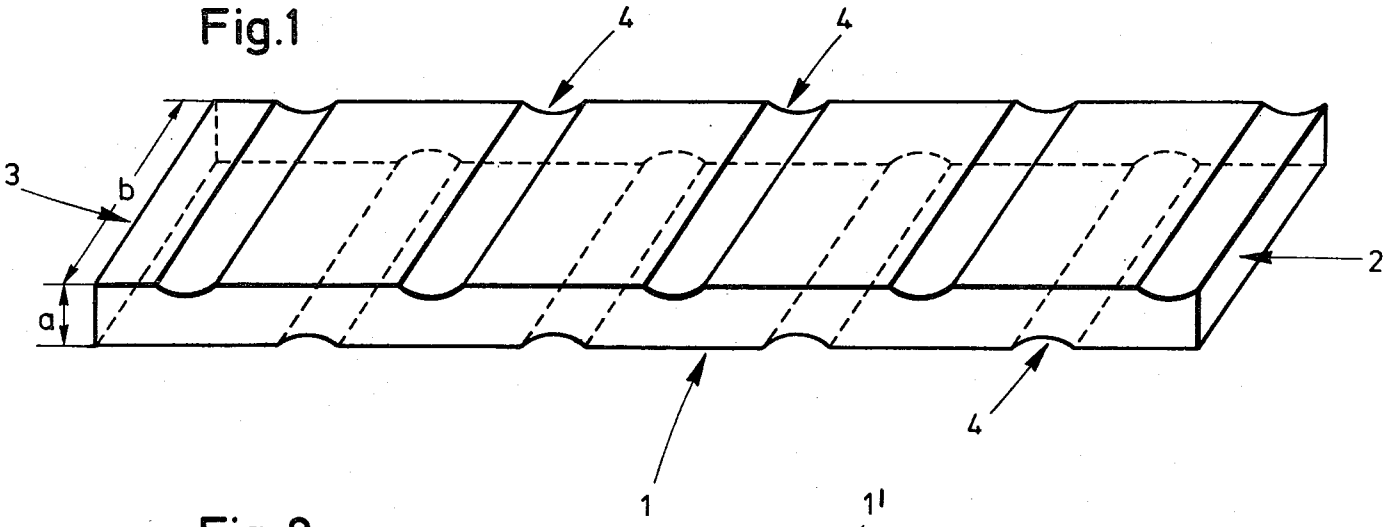
FIG. 1 is a top view from the top right showing a heating zone according to the invention.

An apparatus for carrying out the method according to the invention, which is especially characterized by its structural simplicity and economy, shows the feature that oppositely disposed, mutually offset deflection means are arranged in the heating zone.

A further apparatus for carrying out the method according to the invention is characterized by the feature that mutually offset guide plates are provided as deflection means in the heating zone.

A further apparatus for carrying out the method according to the invention is characterized by the feature that mutually offset indentations 4, 4', 6 are provided as deflection means in the heating zone.

In accordance with the invention tubes 1, 1', 5 which are derived from tubes having a circular or rectangular cross-sectional profile are particularly suitable for being used as heating zone. This means that a cross-section through one of the tubes 1, 1', 5 at a location at which no deflection means according to the invention are provided will represent a circular or rectangular profile.

Tubes 1, 1', 5 through which tobacco parts, introduced in the stream of the gaseous heating medium, flow at high speeds are particularly suitable for being used as heating zone. Since, according to the invention, the additional heat absorption from the hot inner wall of the heating zone is utilized by the combination of heat radiation and heat conduction, it is advantageous to use tubes having the largest possible cross-section and, consequently, a large radiation surface. Hence, the tubes 1, 1' should preferably have a rectangular cross-section, especially one with a ratio of width (b) to height (a) of $\geqq 2$, preferably $\geqq 3$. On the basis of this ratio it is achieved that, on the one hand, the tubes 1, 1' are provided with a large surface and that, on the other hand, the distances between the wall and the tobacco particles remain small. By means of a suitable structural design of the deflection means of opposite tube walls the direction of flow of the impregnated tobacco parts in the longitudinal direction of the tube 1, 1', 5 is disturbed so that the main direction of movement is approximately equal to a zigzag path and that, consequently, the tobacco particles remain in the vicinity of the wall as long as possible and as closely as possible.

In the case of one suitable embodiment the indentations 4, 4', 6 are provided with a curve-like, e.g. circular segment like profile and are arranged at right angles to the longitudinal direction of the tube 1, 1', 5 continuously without any interruptions, but offset relative to the opposite tube wall. This structural design of the indentations 4, 4', 6 has the effect that portions of reduced cross-section and portions of enlarged cross-section are alternately provided in the direction of flow. Due to the many changes in direction it is achieved that the tobacco particles are frequently guided into contact with the hot inner wall of the tube at an angle of predominantly less than 45° and/or into the immediate neighbourhood of said hot inner wall, whereby heat is transferred to the particles by the combination of direct heat conduction and heat radiation so that temperature transfer occurs more rapidly.

In the case of an additional embodiment the indentations 6 consist of a plurality of spherical cups. As has already been described in connection with the previous embodiment, in this case, too, the flow path of the impregnated tobacco particles is advantageously altered in a similar manner. The changes in cross-section according to the invention also result in an increased turbulence of the flow, which exerts a favourable influence on the entry of the gaseous heating medium and and which improves the transfer of heat between the gaseous heating medium and the tobacco.

A particularly simple embodiment is characterized by the feature that the two oppositely disposed tube walls consist of mutually offset, corrugated sheet-metal members.

The outer walls of the heating zone designed according to the invention can be additionally provided with heating means. The intensity of heating is preferably chosen such that the temperature inside the heating zone is between 100° and 250° C.

The apparatus shown in FIG. 1 consists of a tube 1 whose inlet opening 2 and outlet opening 3 have a rectangular profile with a ratio of width (b) to height (a) $\geqq 3$. The indentations 4 have a circular segment like profile and are arranged at right angles to the longitudinal direction of the tube 1 continuously without any interruptions, but offset relative to the opposite surface.

Figure 2:
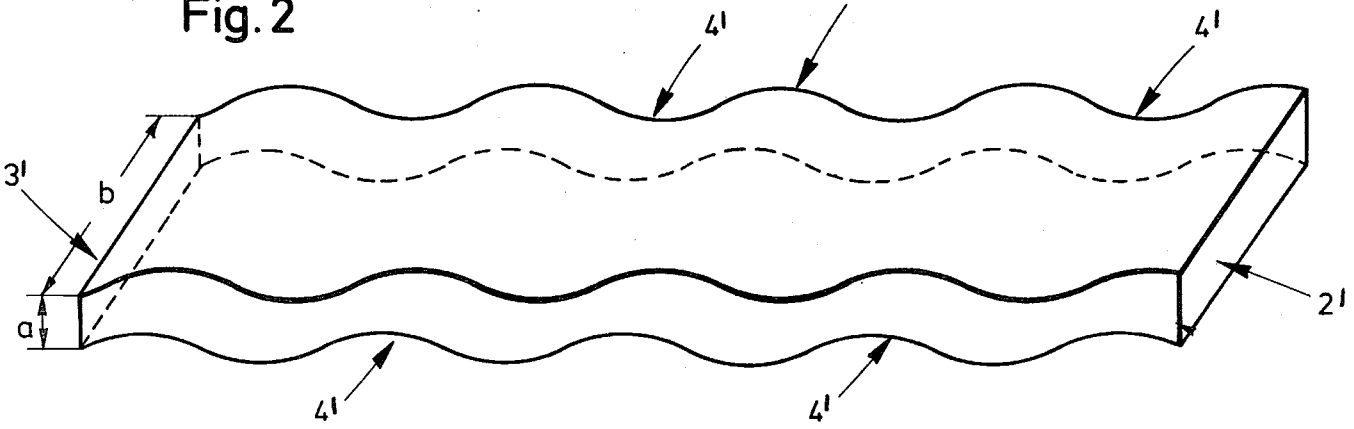
FIG. 2 is also a top view from the top right showing a further embodiment of a heating zone according to the invention.

FIG. 2 shows another embodiment of a heating zone according to the invention. The inlet opening 2' and the outlet opening 3' of this tube have the same profile as tube 1 in FIG. 1. The tube 1' consists of flat corrugated sheet-metal members whose indentations 4' extend at right angles to the longitudinal direction of the tube 1'.

Figure 3:
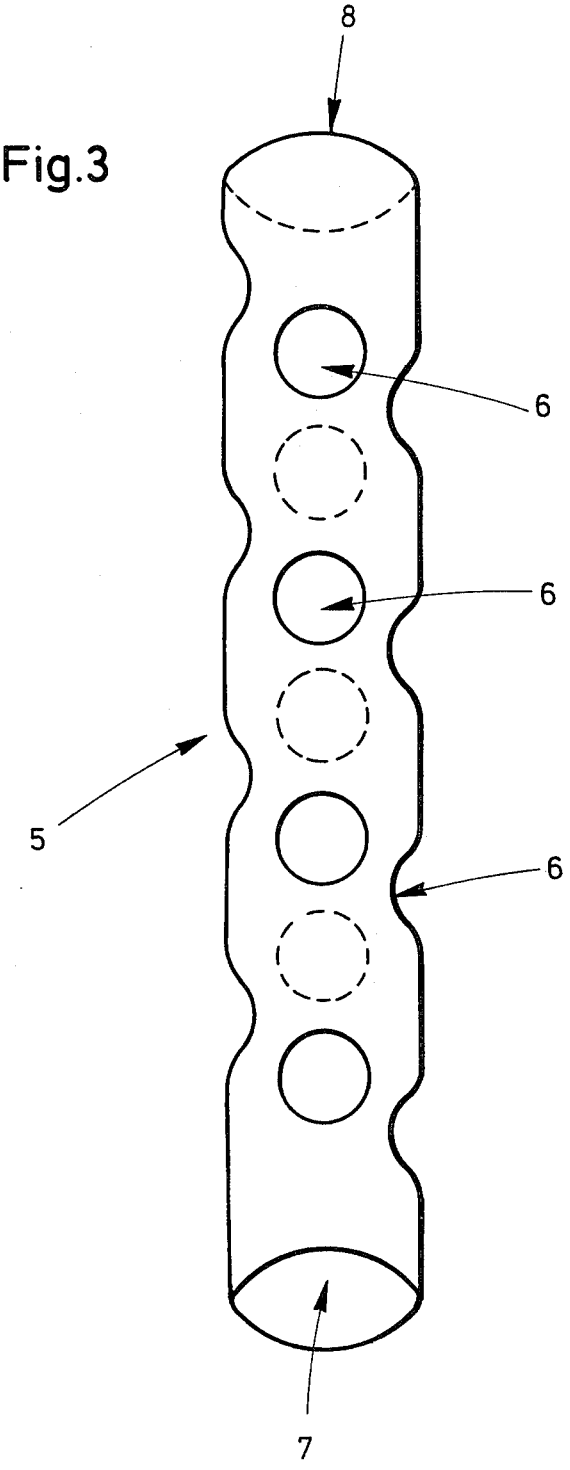
FIG. 3 is a view from below showing a further embodiment of a heating zone according to the invention and FIG. 4 is a schematic representation of the most important parts of the apparatus according to the invention.

FIG. 3 shows a further embodiment of a heating zone according to the invention. The inlet opening 7 and the outlet opening 8 of this tube 5 have a circular profile, i.e. the basic cross-section of this tube 5 also has a circular profile. The tube 5 has provided therein a plurality of indentations 6 in the form of spherical cups which are arranged at regular intervals, but offset relative to one another.

In the case of an additional embodiment, the heating zone according to the invention has provided therein a plurality of mutually offset steam and/or gas inlet locations used as deflecting means.

Figure 4:
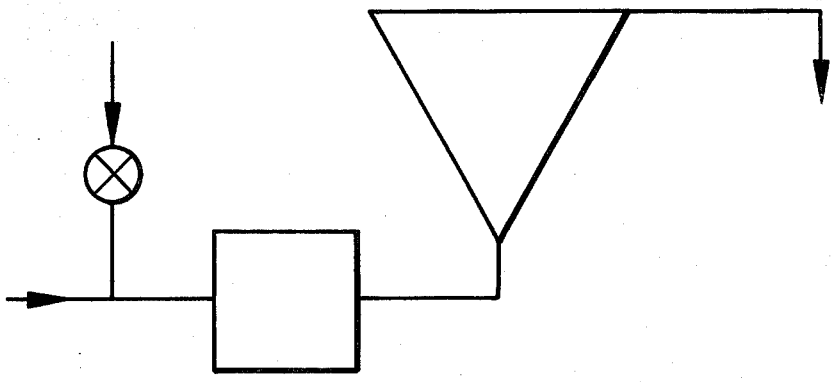

FIG. 4 is a schematic representation of the essential parts of the apparatus according to the invention. Impregnated tobacco rib parts as well as the gaseous heating and transport medium containing steam are introduced into the expansion zone. The expanded tobacco rib parts are supplied from the expansion zone to the lower end of a drying zone which preferably has the shape of an inverted cone. The dried and expanded tobacco rib parts are drawn off at the upper end of the drying zone and are subjected to further processing.

The following examples demonstrate the use of the method according to the invention as well as the results achieved.

In the case of all the treatments described, the cut ribs were moistened in a commercially available moistening drum and subsequently treated in a pneumatic transport system of the type mentioned hereinbefore. The filling quality measurements of the cut ribs were carried out with the aid of a Borgwaldt densimeter and refer to a standard moisture of 13% of the material tested.

EXAMPLE 1

Material Light Virginia Cut Ribs

| | Sample A | Sample B |
|---|---|---|
| Initial moisture content (% wc) | 50.0 | 50.0 |
| Final moisture content (% wc) | 13.0 | 8.0 |
| Temperature upon introduction of the tobacco (°C.) | 160 | 260 |
| Dwell time (s) | 16 | 7 |
| Amount of material through 0.75 mm sieve (%) | 1.1 | 6.0 |
| Filling power (ml/g) | 6.08 | 5.65 |
| Increase in the filling power- in comparison with untreated material | +60.8% | +49.5% |

Test cigarettes were made from both the samples treated as well as from untreated cut ribs; sample B was moistened to 13% water content and was mixed to an amount of 10% with a standard tobacco mixture. Sample A as well as the untreated cut ribs were mixed with the same standard tobacco mixture in the same ratio without any further conditioning. The cigarettes were conditioned and sorted according to equal firmness.

| | Sample A | Sample B | untreated |
|---|---|---|---|
| Average weight of the cigarettes (mg) | 1078 | 1095 | 1138 |
| Moisture | 12.4 | 12.4 | 12.4 |
| Firmness (mm penetration depth) | 1.9 | 1.9 | 1.9 |
| Amount of tobacco saved (mg/cig) | 60 | 43 | — |
| Amount of tobacco saved (%) | 5.3 | 3.8 | — |

EXAMPLE 2

Material: Rolled and cut Maryland ribs

| | Sample C* | Sample D** |
|---|---|---|
| Initial moisture content (% wc) | 55.0 | 55.0 |
| Final moisture content (% wc) | 13.4 | 13.4 |
| Temperature upon introduction of the tobacco (°C.) | 155 | 190 |
| Dwell time (s) | 18 | 18 |
| Filling power (ml/g) | 7.25 | 6.82 |
| Increase in the filling power in comparison with untreated material | +65.7% | +55.8% |

*Sample C was treated in a pneumatic system which had provided therein a member according to the embodiment shown in FIG. 2.

**Sample D was treated in a pneumatic system which had provided therein a smooth tube instead of the above-mentioned member, said smooth tube having a cross-section comparable to that of the above-mentioned member.

EXAMPLE 3

Material: Rolled and cut mixture of dark ribs

| | Sample E | Sample F |
|---|---|---|
| Initial moisture content (% wc) | 52 | 52 |
| Moistening with | water | water + $Na_2HPO_4$ |
| Phosphate content (% dry cut ribs) | — | 0.8 |
| Final moisture content (wc) | 12.8 | 12.9 |
| Smoker's judgement | harsh, a bit less aromatic | aromatic, no substantial change in comparison with the untreated specimen |

What is claimed is:

1. A method of increasing the volume of cut tobacco stems comprising impregnating the tobacco stems to a water content of at least 45% by weight with an impregnating agent containing at least water, expanding the impregnated tobacco stem parts in an expansion zone with a gaseous heating and transport medium containing steam and having a temperature of from about 105° C. to about 250° C., and drying the expanded tobacco stem parts in a drying zone at a temperature of about 110° C. to 150° C. to a final moisture content of at least 12.5% by weight, the tobacco stem parts being transported during the heating and drying process through a pneumatic transport system by the very same heating and transport medium, the direction of movement and the relative speeds of the tobacco stem parts in the expansion zone being changed several times relative to the gaseous heating and transport medium, and the tobacco stem parts in the drying zone being subjected to a lower temperature and a reduced flow velocity relative to the conditions at the end of the expansion zone.

2. The method according to claim 1, wherein the tobacco stem parts are dried within a period of about 10 to about 20 seconds.

3. The method according to one of the claims 1 or 2, wherein the tobacco stem parts are dried to a final moisture content of from 13 to 14% by weight.

4. The method according to one of the claims 1 to 3, wherein prior to the expansion zone, the tobacco stem parts are impregnated to a water content of from 50% to 60% by weight.

5. The method according to one of the claims 1 to 4, wherein the gaseous heating and transport medium contains at least 50 percent by volume of steam.

6. The method according to one of the claims 1 to 5, wherein immediately before the expansion of the tobacco stem parts, the gaseous heating and transport medium has a temperature of from 150° C. to 180° C.

7. The method according to one of the claims 1 to 6, wherein the impregnating agent contains water and orthophosphoric acid and/or at least one of the sodium salts thereof.

8. The method according to claim 7, wherein the impregnating agent contains orthophosphoric acid and/or the sodium salts thereof in an amount of from 0.1 to 1.0% by weight based on the dry weight of the tobacco ribs.

9. The method according to one of the claims 1-6, wherein in the drying zone the gaseous heating and transport medium of reduced velocity has a temperature of from about 110° C. to about 150° C.

10. An apparatus for increasing the volume of cut tobacco stems comprising an expansion zone provided with deflection means and further comprising a subsequent drying zone, wherein said deflection means are oppositely disposed and arranged mutually offset such that the trajectory of the tobacco parts is guided towards the opposite wall in such a way that said tobacco parts meet the hot inner wall of the expansion zone or the immediate neighbourhood of said hot inner wall at an angle of preferably less than 45°.

11. The apparatus according to claim 10, wherein mutually offset guide plates are provided as deflection means in the expansion zone.

12. The apparatus according to claim 10 or 11, wherein mutually offset indentations (4, 4', 6) are provided as deflection means.

13. The apparatus according to one of the claims 10 to 12, wherein the expansion zone is a tube (5) having a circular cross-section.

14. The apparatus according to one of the claims 10 to 12, wherein the expansion zone is a tube (1, 1') having a rectangular cross-section.

15. The apparatus according to claim 14, wherein said rectangular cross-section has a ratio of width (b) to height (a) of $\leqq 2$, preferably $\leqq 3$.

16. The apparatus according to claim 14 or 15, wherein the indentations (4) define a curve-like profile and are provided at right angles to the longitudinal direction of the tube (1) over the whole width (b).

17. The apparatus according to one of the claims 14 to 16, wherein the indentations (4) define a circular segment-like profile and are provided at right angles to the longitudinal direction of the tube (1) over the whole widht (b).

18. The apparatus according to one of the claims 10 to 17, wherein the indentations (6) consist of a plurality of spherical cups.

19. The apparatus according to one of the claims 10 to 18, wherein tube (1) consists of oppositely disposed, mutually offset, corrugated sheet-metal members.

20. The apparatus according to claim 10, wherein mutually offset inlet locations are provided as deflection means in the expansion zone.

21. The apparatus according to one of the claims 10 to 20, wherein the outer walls of the expansion zone are additionally heated.

22. The apparatus according to one of the claims 10 to 21, wherein an enlargement of the flow cross-section in the direction of transport of the tobacco parts is provided in part of the drying zone for reducing the flow velocity.

* * * * *

UNITED STATES PATENT OFFICE

CERTIFICATE OF CORRECTION

Patent No. 4,483,352 Dated November 20, 1984

Inventor(s) Laszlo Egri

It is certified that error appears in the above-identified patent and that said Letters Patent are hereby corrected as shown below:

Column 3, line 26: "duct" should read --dust--.

Column 6, line 26: "deflecting" should read --deflection--.

Column 8, line 53: "of $\leq$ 2, preferably $\leq$ 3" should read --of $\geq$ 2, preferably $\geq$ 3--.

Column 8, line 62: "widht" should read --width--.

Signed and Sealed this

*Nineteenth* Day of *November 1985*

[SEAL]

*Attest:*

DONALD J. QUIGG

*Attesting Officer* *Commissioner of Patents and Trademarks*